United States Patent [19]

Ripley

[11] 4,363,220

[45] Dec. 14, 1982

[54] ICE MAKING APPARATUS

[76] Inventor: Wayne H. Ripley, P.O. Box 2666, San Angelo, Tex. 76902

[21] Appl. No.: 305,689

[22] Filed: Sep. 25, 1981

[51] Int. Cl.[3] ..... F25C 1/12

[52] U.S. Cl. ..... 62/138; 62/347; 62/352

[58] Field of Search ..... 62/347, 348, 352, 138, 62/73, 74; 165/146

[56] References Cited

U.S. PATENT DOCUMENTS

| | | | |
|---|---|---|---|
| 2,672,016 | 3/1954 | Muffly | 62/352 X |
| 2,774,223 | 12/1956 | Muffly | 62/348 X |
| 2,940,276 | 6/1960 | Loewenthal et al. | 62/348 X |
| 2,997,861 | 8/1961 | Kocher et al. | 62/347 |
| 3,200,611 | 8/1965 | Van Steenburgh, Jr. | 62/298 |
| 3,206,944 | 9/1965 | Gallo | 62/347 |
| 3,280,585 | 10/1966 | Lowe | 62/352 X |
| 3,430,452 | 3/1969 | Dedricks et al. | 62/347 X |
| 4,255,941 | 3/1981 | Bouloy | 62/348 X |

*Primary Examiner*—William E. Tapolcai
*Attorney, Agent, or Firm*—Jacobi, Siegel, Presta, Marzullo & Aronson

[57] ABSTRACT

Ice making apparatus having one or more corrugated freezing plates with substantially vertical channels in which water flows to form ice cubes. Angled penetration lugs are secured to one surface of each freezing plate at vertically spaced intervals along the bent portions of the freezing plate defining the channels, and the refrigeration line is in contact with each of the penetration lugs so that ice cubes are formed evenly in vertically spaced relation along each of the channels defined by the bent portions of the freezing plate. The penetration lugs are bent at substantially the same angle as the bent portions of the freezing plate, and the lugs are bent or wrapped around the refrigeration line to maximize penetration. A thermostat is positioned at an angle adjacent one of the channels and near a cube to be formed that is below the uppermost cube. When the ice cubes reach a predetermined size, the thermostat is contacted by the adjacent cube and by the falling cube or cubes above it to close a circuit to a hot gas valve for the purpose of starting the defrost cycle and the ice harvest. The stacking of cubes in the channel against the thermostat serves to maximize the harvest cycle and insure the harvesting of all of the cubes on the freezing plates. A siphon device in the water reservoir periodically removes water therefrom to minimize impurities in the water.

10 Claims, 6 Drawing Figures

FIG.1
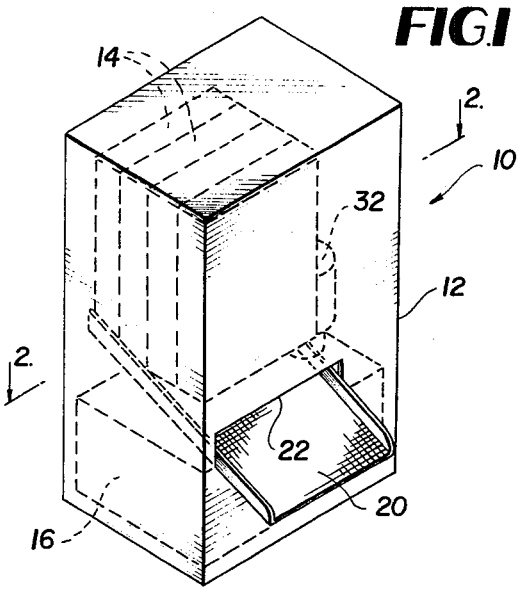
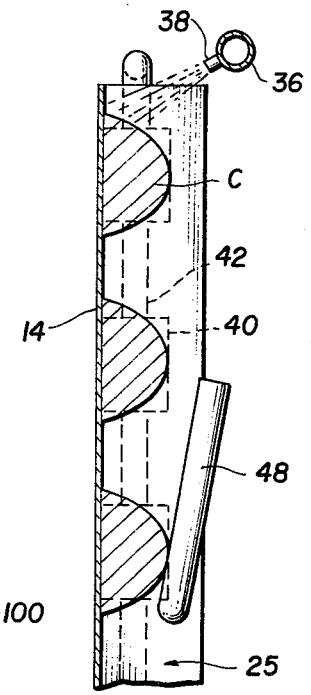
FIG.4
FIG.5
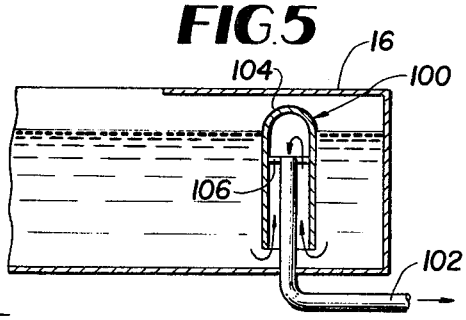
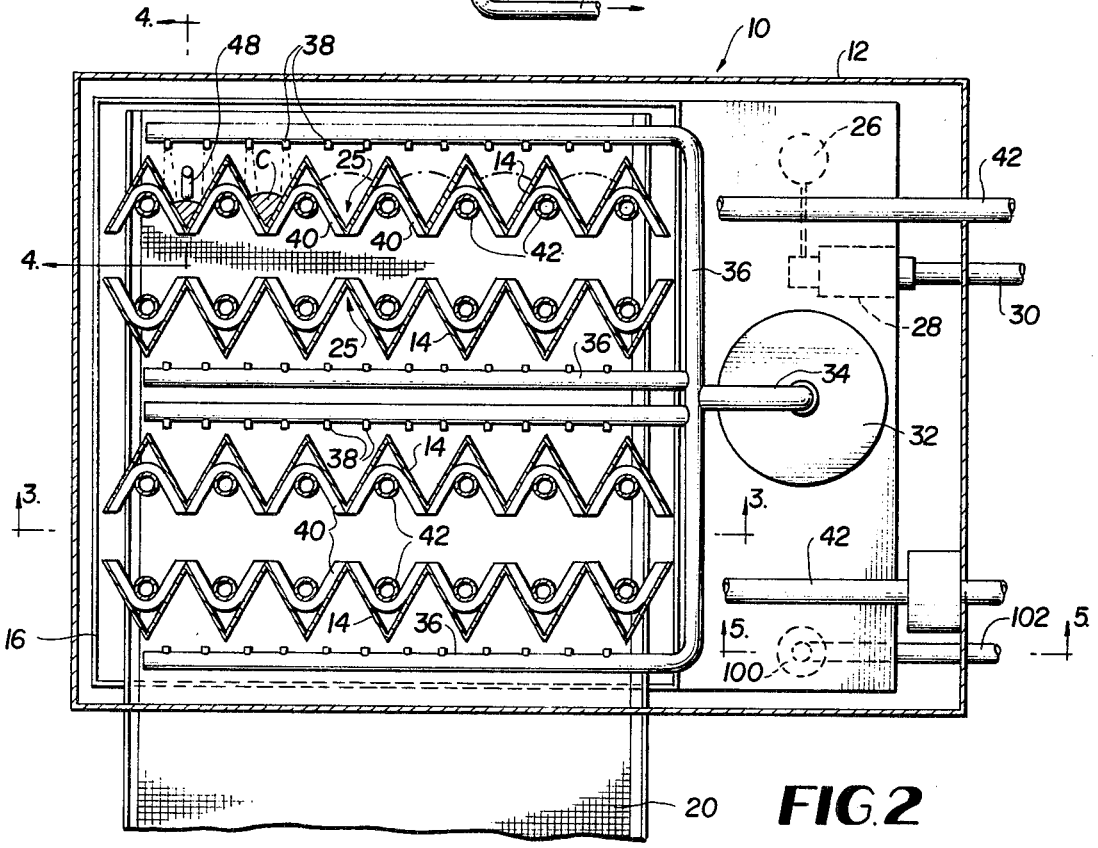
FIG.2

FIG. 3
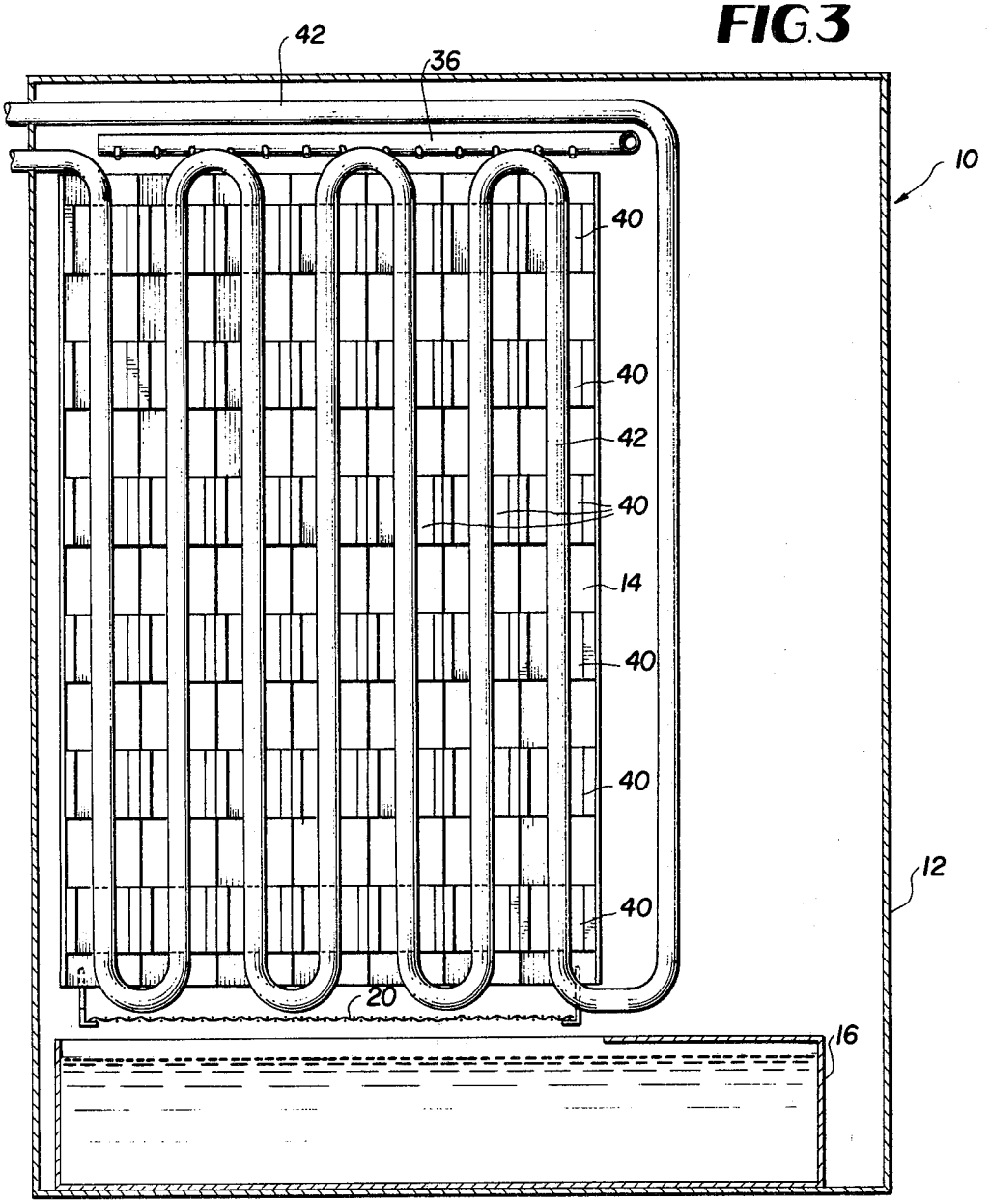
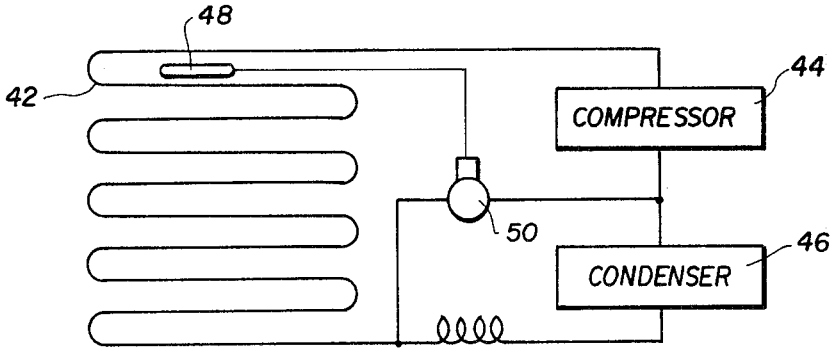
FIG. 6

ICE MAKING APPARATUS

BACKGROUND OF THE INVENTION

Many conventional ice making machines for providing ice cubes or the like require the carrying out of two major steps. First, a slab of ice is formed and, second, the slab is then cut in some manner to provide the cubes. This type of prior art ice making machine requires moving parts or at least auxiliary equipment to effect the cutting operation of the slab of ice once the slab has been formed. Accordingly, such machines are complicated in construction and are difficult to provide in compact configuration as a consequence of the necessity for cutting the slab.

In other types of conventional ice making machines, the cubes are formed in molds or the like and heating means are provided to separate the cubes from the molds when the cubes reach a predetermined size. The ice making machines of this type that have been used in the past or are presently in use have been subject to one or more of the following disadvantages:

1. Owing to shart corners and seams in the molds, they have accumulated dirt and have been difficult to clean and to remove ice cubes therefrom;
2. They have been complicated in construction and, accordingly, difficult and expensive to manufacture and/or operate;
3. They have been too slow in operation and thus incapable of providing a suitable number of ice cubes in an optimum shape in a short period of time; and
4. They have been bulky in size and, owing to their construction and operation, have been difficult to manufacture in a compact configuration.

It will be readily seen, therefore, that a need has arisen for a compact, efficient and inexpensive ice making machine which is capable of continuously producing a suitable number of ice cubes or the like having an optimum shape and no impurities in a short period of time.

SUMMARY OF THE INVENTION

The ice making apparatus of the present invention is not subject to any of the disadvantages of the prior apparatus described above, and possesses advantages not possessed by ice making apparatus used in the past or present.

In a preferred embodiment, the ice making apparatus of the present invention comprises one or more corrugated freezing plates with substantially vertical channels through which water can flow to form ice cubes. Angled penetration lugs are secured to one surface of each freezing plate at vertically spaced intervals along the bent portions of the freezing plate defining the channels. A refrigeration line is in contact with each of the penetration lugs so that ice cubes are formed evenly in vertically spaced relation in each of the channels defined by the bent portions of the freezing plate. The penetration lugs are bent at substantially the same angle as the bent portions of the freezing plate, and the lugs are bent or wrapped around the refrigeration line to maximize penetration.

A water storage tank is provided underneath the freezing plate and a pump serves to supply water to a water spray head or the like disposed above the freezing plates for the purpose of directing water into each channel of the freezing plates. The water that is not frozen on the freezing plates falls down into the storage tank and is recirculated to the spray head disposed above the freezing plates. A siphon device in the storage tank periodically removes water therefrom to minimize impurities in the water.

A thermostat is positioned adjacent one of the channels in the freezing plate and near a cube to be formed that is below the uppermost cube. When the ice cubes reach a predetermined size, the thermostat is contacted by the adjacent cube and by the falling cube or cubes above it to close a circuit to a hot gas valve for the purpose of starting the defrost cycle and the ice harvest. The stacking of cubes in the channel against the thermostat serves to maximize the harvest cycle and insure the harvesting of all of the cubes on the freezing plates. Thereafter, the thermostat open the circuit to the hot gas valve and the freezing cycle is again started.

BRIEF DESCRIPTION OF THE DRAWINGS

FIG. 1 is a perspective view generally showing the ice making apparatus constructed in accordance with the principles of the present invention;

FIG. 2 is an enlarged sectional view taken substantially along line 2—2 in FIG. 1;

FIG. 3 is a sectional view taken substantially along line 3—3 in FIG. 2;

FIG. 4 is an enlarged sectional view, with parts broken away, taken substantially along line 4—4 of FIG. 2;

FIG. 5 is an enlarged sectional view, with parts broken away, taken substantially along line 5—5 in FIG. 2; and FIG. 6 is a schematic view of the cooling and defrost cycle of the ice making apparatus of the present invention.

DESCRIPTION OF THE PREFERRED EMBODIMENTS

In FIG. 1 of the drawings, there is illustrated a preferred embodiment of the ice making apparatus of the present invention. This ice making apparatus 10 comprises a housing 12 of any suitable configuration and formed of any suitable material, one or more freezing plates 14 disposed within the housing 12, a water storage tank 16 disposed within the housing 12, a pump 32 for delivering water from the storage tank to the upper portion of the freezing plates 14, and a perforated tray or grid 20 upon which ice cubes are delivered from the freezing plate 14 to a storage bin (not shown) or the like. The tray 20 extends from beneath the freezing plate 14 within the housing 12 to the exterior of the housing through an aperture 22 therein.

As specifically shown in FIGS. 2 and 3, each freezing plate 14 is of generally planar configuration and is corrugated so as to define a plurality of substantially V-shaped, vertically extending channels 25 on one side thereof. Preferably, the freezing plates 14 are formed of stainless steel or another suitable material.

The water storage tank 16 is disposed beneath the freezing plates 14 and is provided with a float 26 and float-actuated valve 28 for the purpose of automatically introducing water therein through supply line 30, so as to maintain the water in tank 16 at a predetermined level. A pump 32 of any suitable construction is mounted on the water storage tank 16 within the housing 12 for the purpose of pumping water from the tank 16 upwardly through the water line 34 and into a water supply head 36 disposed above the freezing plates 14. Extending downwardly from the water supply head 36 into each of the channels 24 in the freezing plates 14 are a plurality of nozzles 38 or the like for the purpose of delivering a stream or spray of water into each of the channels of the freezing plates.

In this manner, water from the storage tank 16 is conveyed by the pump 32 and line 34 to the water supply head 36 and through the nozzles 38, and then down into each of the channels 24 in the freezing plate 14. Any excess water which is not formed into ice cubes on the freezing plates 14 falls through the perforations in the ice cube tray 20 and into the storage tank 16 for recirculation back to the water supply head 36. The water supply head 36 may be mounted on or secured to the upper portion of the freezing plates 14 in any suitable manner and, preferably, the supply head 36 is formed of a material such as stainless steel or the like.

When the water pump 32 is turned off and excess water enters the storage tank 16, a siphon device 100 shown in FIG. 5 serves to remove water from the bottom of the tank so as to periodically remove impurities therefrom that settle to the bottom thereof. The siphon device 100 comprises a drain pipe 102 and a bonnet 104 secured to the upper portion thereof by ribs 106 or other suitable means.

For the purpose of freezing into ice cubes the water flowing down each of the channels 24 of the freezing plates 14, a plurality of angled, curved or generally V-shaped penetration lugs 40 are secured in any suitable manner in vertically spaced relation to one surface of each of the freezing plates 14. As shown in FIGS. 2 through 4, the penetration lugs 40 are secured in vertically spaced relation to the surfaces of the freezing plates that define and are opposite to the vertically extending channels 24 therein. Preferably, the penetration lugs 40 are formed of copper or another good temperature conducting material. Also, the lugs 40 are bent at an angle that is substantially the same as or similar to the angle of the adjacent bent portions of the freezing plates 14 so that the legs of the lugs are substantially parallel to and in substantially continuous engagement with the adjacent surfaces of the freezing plates. In this manner, the legs of adjacent penetration lugs 40 surround the ice cubes forming channels 24 on the opposite sides of the freezing plates 14 in a substantially continuous manner to effect the rapid formation of ice cubes in the channels 24 as described more fully hereinafter.

A refrigeration line 42 formed of copper or another suitable material extends in an undulating manner in engagement with the lugs 40 in the channels on the sides of each of the freezing plates 14 that are opposite to the sides having the ice cube forming channels 24. As shown in FIG. 2, the lugs 40 are bent around and surround the adjacent portions of the refrigeration line 42 so as to maximize contact therewith.

As shown schematically in FIG. 6, the refrigeration line 42 is connected in a conventional manner to a compressor 44 and a condenser 46 for the purpose of cooling the refrigerant in the line 42. Any suitable or conventional refrigerant may be provided within line 42. The low temperature of the refrigerant within line 42 surrounding the freezing plate 14 is rapidly transferred from the refrigeration line 42 through the lugs 40 and to the adjacent portions of the freezing plate 14 defining the channels 24 therein for the purpose of freezing the water flowing down the channels from the water supply head 36 into ice cubes at the portion of each channel adjacent the lugs 40. Through the use of the angled penetration lugs 40, and their close engagement with the freezing plates and the refrigeration line, the low temperature is rapidly transferred to the freezing plates and ice cubes are formed uniformly in each channel 24 in vertically spaced positions corresponding to the legs of adjacent lugs 40. Because of the V-shaped channels, the cubes are formed with two flat sides and one curved side, as shown in broken lines in FIG. 2 and identified by the letter C. Because of the shape of these cubes, they are attractive in appearance and convenient to use.

For the purpose of harvesting the cubes C once they are formed on the freezing plate 14, a thermostat 48 is positioned adjacent one or more of the channels 24 in the freezing plates 14, as shown in FIGS. 2 and 4. The thermostat 48 may be mounted on the adjacent freezing plate 14 in any suitable manner (not shown). In accordance with the present invention, the thermostat 48 preferably extends into the adjacent ice cube forming channel 24 toward the center portion thereof at an angle, with the lower or inner end thereof in a position to be engaged by a cube to be formed in the channel that is below the uppermost cube to be formed therein. As an illustrative example, the thermostat 48 may extend into the adjacent channel 24 at an angle of approximately ten (10) degrees to the vertical, and its inner end may be positioned to be engaged by the cube to be formed that is the third cube down from the top of the channel, as shown in FIG. 4.

When the ice cubes C reach a predetermined size, the thermostat 48 is contacted by the adjacent cube C to close a circuit to a hot gas valve 50 (shown in FIG. 6) for the purpose of starting the defrost cycle and the ice harvest. As shown in FIG. 6, the opening of the hot gas valve 50 allows hot gas from the compressor 44 to flow into the portion of the refrigeration line 42 surrounding the freezing plates 14 so as to cause the formed ice cubes C to fall from the freezing plates 14 down onto the inclined, perforated entry 20 and then into a storage bin (not shown) or the like. Because of the position of the thermostat 48 below the uppermost cube in the channel 24, the cube or cubes formed above the thermostat will fall and stack up against the thermostat 48 for a short time which serves to extend the harvest cycle and insure the harvesting of all of the cubes formed on the freezing plates 14. The ice cube tray 20 serves to prevent any cubes from falling into the water storage tank 16, and any excess water flowing down the channels 24 of the freezing plate 14 will fall through the perforations in the tray 20 and into the water storage tank 16 for recirculation back to the water supply head 36 and a repeat of the ice cube forming cycle described herein.

What is claimed is:

1. Ice making apparatus comprising:

an upstanding, corrugated freezing plate defining a plurality of substantially vertically extending ice cube forming channels on one side thereof, a plurality of vertically spaced lugs in engagement with the opposite side of said freezing plate, each of said lugs being angled and having legs substantially parallel to and in close engagement with the adjacent surfaces of said freezing plate on said opposite side thereof so that legs of adjacent lugs surround said ice cube forming channels on said one side of said freezing plate to define vertically spaced ice cubes forming areas in said channels, a refrigeration line in engagement with said lugs, means for supplying water to said one side of said plate at the upper end thereof, whereby water flows down said one side of said plate into said channels and is frozen to form ice cubes thereon at vertically spaced locations adjacent to said lugs, and means to effect removal of the ice cubes from said plate when they reach a predetermined size.

2. The apparatus of claim 1 wherein said refrigeration line contains a refrigerant; and said removal means comprises a thermostat positioned in one of said channels to be engaged by an adjacent ice cube when it reaches said predetermined size, and means actuated by said thermostat for supplying hot fluid to said refrigeration line to harvest the ice cubes.

3. The apparatus of claim 1 wherein said water supplying means comprises a water storage tank positioned beneath said plate, means for conveying water from said storage tank to the upper end of said plate, and means for supplying water to said tank to maintain a predetermined level of water therein.

4. The apparatus of claim 1 wherein said refrigeration line is in engagement with the angled portion of each of said lugs, and the legs of each lug surround and are in close engagement with said refrigeration line to maximize temperature transfer therebetween.

5. The apparatus of claim 1 wherein said lugs and said channels are substantially V-shaped in transverse cross section.

6. The apparatus of claim 3 wherein a perforated tray is positioned between the lower end of said freezing plate and said storage tank to receive ice cubes falling from said plate and to allow excess water to pass therethrough into said storage tank for recirculation to the upper end of said plate.

7. The apparatus of claim 6 wherein siphon means is positioned in said storage tank to remove water and impurites from the bottom portion thereof when excess water accumulates therein.

8. The apparatus of claim 1 wherein said water supplying means comprises a water supply head having a plurality of nozzles for directing streams of water to said channels at the upper end thereof.

9. The apparatus of claim 1 wherein a plurality of freezing plates are disposed in substantially parallel relation.

10. The apparatus of claim 2 wherein said thermostat is disposed at an angle to the vertical and is positioned to be engaged by an adjacent cube formed in said one channel that is below the uppermost cube to be formed therein, whereby cubes formed in said channel above said adjacent cube will temporarily stack up against said thermostat to maximize the period for harvesting the ice cubes.

* * * * *